US006779201B1

(12) United States Patent
Pfrommer

(10) Patent No.: US 6,779,201 B1
(45) Date of Patent: Aug. 24, 2004

(54) LOOP LATCH

(76) Inventor: Walt Pfrommer, 96 Maidencreek Rd., Fleetwood, PA (US) 19522

( * ) Notice: Subject to any disclaimer, the term of this patent is extended or adjusted under 35 U.S.C. 154(b) by 85 days.

(21) Appl. No.: 10/307,196

(22) Filed: Nov. 27, 2002

Related U.S. Application Data

(60) Provisional application No. 60/346,161, filed on Jan. 8, 2002.

(51) Int. Cl.[7] ..... A41F 9/00

(52) U.S. Cl. ..... 2/321; 24/182

(58) Field of Search ..... 2/338, 310, 335, 2/311–325, 334, 22, 76, 79, 78.3, 455, 227, 236, 237, 242; 24/298–302, 31 R, 182, 580.1, 578.15, 173, 174; 128/99.1, 100.1, 101.1, 102.1

(56) References Cited

U.S. PATENT DOCUMENTS 4,308,672 A 1/1982 Antonious
4,528,700 A * 7/1985 Johnston ..... 2/338
4,566,207 A 1/1986 Struntz
5,031,576 A * 7/1991 Weinberg ..... 119/865
5,367,714 A * 11/1994 Hines et al. ..... 2/311
5,375,266 A 12/1994 Crisco
5,566,397 A * 10/1996 Scott ..... 2/338
5,575,011 A * 11/1996 Allen ..... 2/227
5,894,640 A 4/1999 Dewey
5,963,988 A 10/1999 Jackson, Jr.
6,318,612 B1 * 11/2001 MacNeil ..... 224/572
6,449,815 B1 * 9/2002 Spiller ..... 24/306
6,678,898 B2 * 1/2004 Jones et al. ..... 2/321

* cited by examiner

*Primary Examiner*—Tejash Patel
(74) *Attorney, Agent, or Firm*—Matthew J. Peirce

(57) ABSTRACT

A belt and belt latch combination for use by individuals is disclosed. The belt would have a belt latch that would use a pair of straps that belong to a hook and loop attachment system for attaching an end of the belt to the belt latch. The end of the belt would also preferably be wrapped around a roller attached to the belt, pulled out, and then extended back to place the two patches of the hook and loop attachment system in contact with one another, ensuring the belt remains removably attached to the belt latch.

3 Claims, 2 Drawing Sheets

LOOP LATCH

This application claims the benefit of Provisional application No. 60/346,161 filed Jan. 1, 2002.

I. BACKGROUND OF THE INVENTION

The present invention concerns that of a new and improved belt and belt latch for use by individuals.

II. DESCRIPTION OF THE PRIOR ART

U.S. Pat. No. 5,963,988, issued to Jackson, Jr., discloses a stretchable elastic fabric for a waistband used in athletic apparel, such as sweatpants.

U.S. Pat. No. 5,894,640, issued to Dewey, discloses a Velcro fastener device for an article of footwear.

U.S. Pat. No. 5,375,266, issued to Crisco, discloses the use of a drawcord used in conjunction with a waistband of clothing, such as sweatpants.

U.S. Pat. No. 4,566,207, issued to Struntz, discloses a Velcro fastener device for an article of footwear.

U.S. Pat. No. 4,308,672, issued to Antonious, discloses a Velcro fastener device for an article of footwear.

III. SUMMARY OF THE INVENTION

The present invention is that of a new and improved belt and belt latch for use by individuals. The belt would have a belt latch that would use a pair of straps that belong to a hook and loop attachment system for attaching an end of the belt to the belt latch. The end of the belt would also preferably be wrapped around a roller attached to the belt, pulled out, and then extended back to place the two patches of the hook and loop attachment system in contact with one another, ensuring the belt remains removably attached to the belt latch.

There has thus been outlined, rather broadly, the more important features of a belt and belt latch combination that the detailed description thereof that follows may be better understood and in order that the present contribution to the art may be better appreciated. There are, of course, additional features of the belt and belt latch combination that will be described hereinafter and which will form the subject matter of the claims appended hereto.

In this respect, before explaining at least one embodiment of the belt and belt latch combination in detail, it is to be understood that the belt and belt latch combination is not limited in its application to the details of construction and to the arrangements of the components set forth in the following description or illustrated in the drawings. The belt and belt latch combination is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present belt and belt latch combination. It is important, therefore, that the claims be regarded as including such equivalent constructions insofar as they do not depart from the spirit and scope of the present invention.

It is therefore an object of the present invention to provide a belt and belt latch combination which has all of the advantages of the prior art and none of the disadvantages.

It is another object of the present invention to provide a belt and belt latch combination which may be easily and efficiently manufactured and marketed.

It is another object of the present invention to provide a belt and belt latch combination which is of durable and reliable construction.

It is yet another object of the present invention to provide a belt and belt latch combination which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Priority is hereby claimed to application Ser. No. 60/346,161, filed on Jan. 8, 2002.

Figure 1:
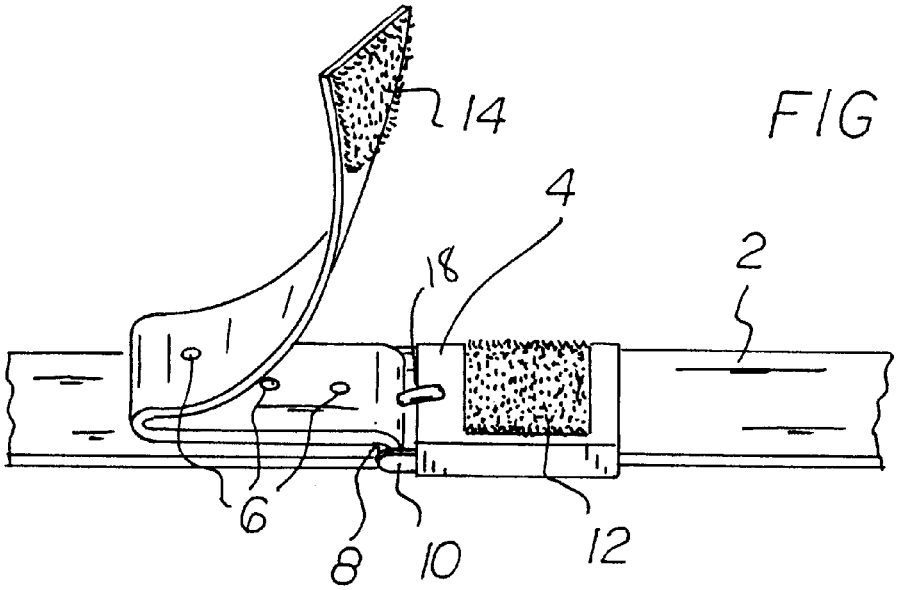
FIG. 1 shows a perspective view of the belt and belt latch of the present invention.
Figure 2:
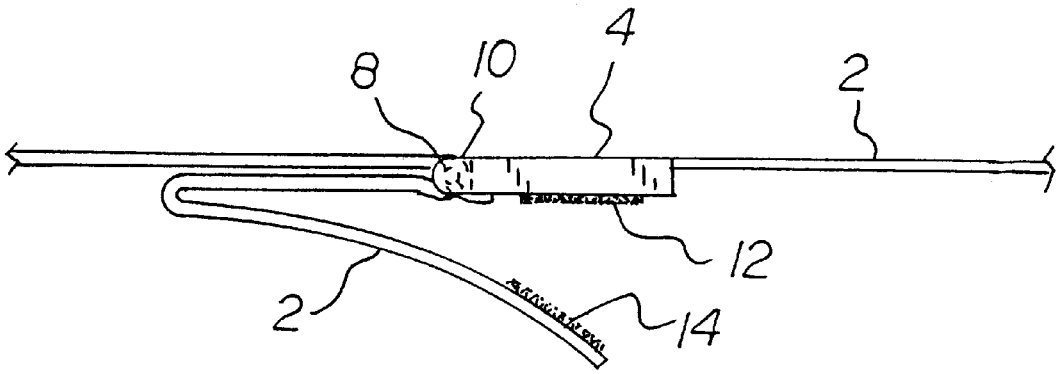
FIG. 2 shows a side view of the belt and belt latch of the present invention.

FIG. 1 shows a perspective view of the belt and belt latch of the present invention, while FIG. 2 shows a side view of the belt 2 and belt latch 4 of the present invention. Belt 2 would preferably be a standard "stretch belt" that is typically used by people while working out and/or exercising. Belt 2 would come in a wide variety of sizes and would have two ends, a first end and a second end, and would have two surfaces, an inner surface and an outer surface. Belt 2 would have a plurality of holes 6 evenly spaced out near the second end of the belt 2 so that a user could fasten the belt 2 at a specific length appropriate for his or her waist.

Latch 4 would be a modified buckle for use with the belt. Latch 4 would be attached to on e of the two ends of the belt and would have two ends, a first end and a second end. The first end of the latch 4 would be attached to the first end of the belt 2, while the second end of the latch 4 would have a roller 8 that would be fastened to latch 4 by connector 10. Latch 4 would also have two surfaces, a top surface and a bottom surface. A prong 18 would be pivotally attached to the middle of the roller 8, with the prong 18 having a sufficient size to allow it to be inserted through one of the holes of the plurality of holes 6.

The top of latch 4 would preferably have a patch 12 glued to it, with the patch 12 being one patch of a two-patch hook and loop fastening system. The inner surface of the second end of belt 2 would also have a patch 14 on it, with the patch being complementary to patch 12.

When fastening the belt 2 to an individual's waist, the individual would pull the second end of the belt 2 through the space in between roller 8 and latch 4. The space in between roller 8 and latch 4 would allow for a very tight squeeze for belt 2. When the appropriate amount of the second end of belt 2 had been inserted through the space in between roller 8 and latch 4, the user would then insert the prong 18 through the nearest adjacent hole 6 of the plurality of holes 6. Then, the user would fold back the second end of belt 2 and place patch 14 against patch 12. The complementary system of the two patches of the hook and loop attachment system would serve to removably attach the second end of belt 2 to patch 12 on the top of latch 4, thereby preventing it from flapping around when the belt 2 would be in use.

For added security and reassurance, a user could take the extra length of the second end of the belt that would be sticking out of the space between the roller 8 and the latch 4 and loop this length around a belt loop on a user's pants before placing patch 14 against patch 12. By doing this, a user would give himself or herself extra added security in knowing that belt 2 would be comfortable.

Figure 3:
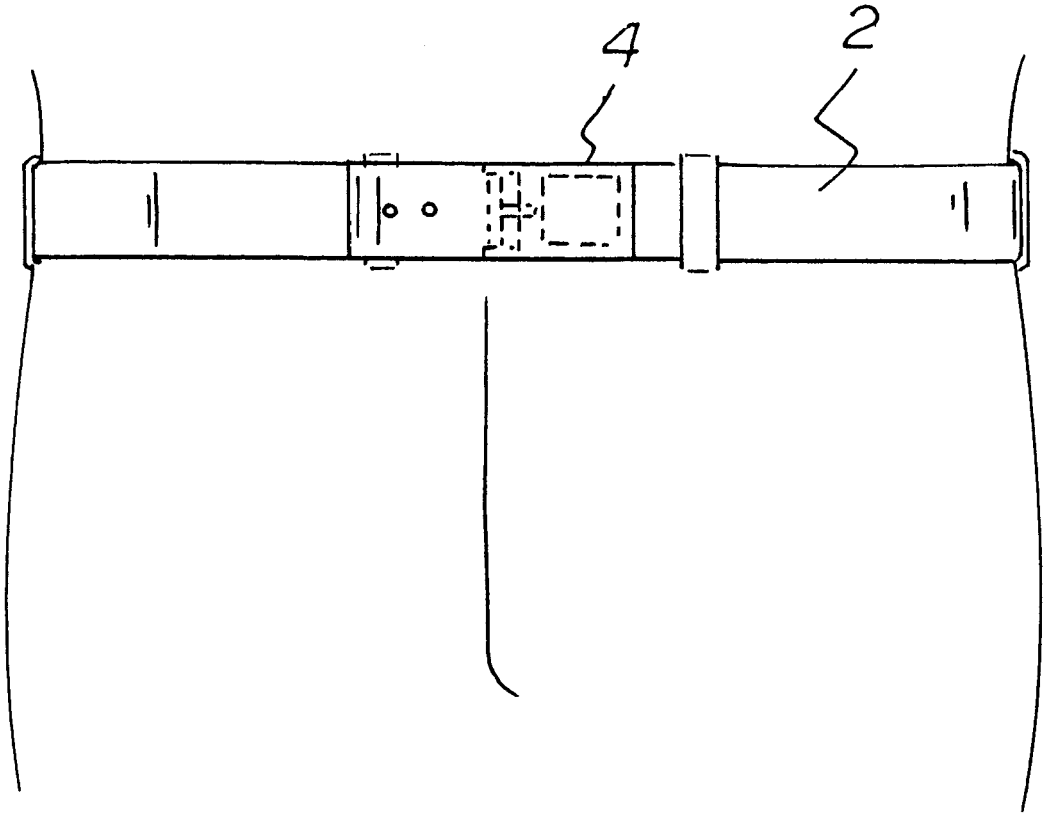
FIG. 3 shows a front view of the present invention in use.

FIG. 3 shows a front view of the present invention in use.

What I claim as my invention is:

1. An apparatus to be worn around an individual's waist to support loose pants, the apparatus comprising:

(a) a belt having two ends, a first end and a second end, the belt also having two surfaces, an inner surface and an outer surface, the belt being fabricated from a stretchable material, the belt having a length and a width, (b) a latch having two ends, a first end and a second end, the first end of the latch being attached to the first end of the belt, the latch having two surfaces, a top surface and a bottom surface, (c) a plurality of holes evenly spaced out on the belt near the second end of the belt, (d) a roller fixedly attached to the second end of the latch by a connector, (e) a prong pivotally attached to the center of the roller, (f) a first patch of a hook and loop attachment system, the first patch attached to the top surface of the latch, (g) a second patch of a hook and loop attachment system, the second patch attached to the inner surface of the belt near the second end of the belt, the second patch of the hook and loop attachment system being complementary to the first patch of the hook and loop attachment system, (h) wherein the belt would be placed around an individual's waist, further wherein the second end of the belt would be pulled through the space in between the roller and the latch until a desired belt tightness had been achieved, further wherein the prong is inserted through one of the holes of the plurality of holes, and further wherein the second end of the belt would be folded back to place the second patch of the hook and loop attachment system in direct contact with the first patch of the hook and loop attachment system.

2. An apparatus to be worn around an individual's waist to support loose pants according to claim 1 wherein the belt is fabricated from elastic.

3. An apparatus to be worn around an individual's waist to support loose pants according to claim 2 wherein the belt is between one and one-half inches to two inches in width.

* * * * *